US009150978B2

(12) United States Patent
Netuschill et al.

(10) Patent No.: US 9,150,978 B2
(45) Date of Patent: Oct. 6, 2015

(54) DEVICE FOR FIXEDLY SECURING A METALLIC INLAY

(71) Applicant: Omega S.A., Bienne (CH)

(72) Inventors: Alexandre Netuschill, Le Locle (CH); Thomas Froelicher, Le Landeron (CH)

(73) Assignee: Omega S.A., Bienne (CH)

( * ) Notice: Subject to any disclaimer, the term of this patent is extended or adjusted under 35 U.S.C. 154(b) by 317 days.

(21) Appl. No.: 13/764,961

(22) Filed: Feb. 12, 2013

(65) Prior Publication Data

US 2013/0208577 A1 Aug. 15, 2013

(30) Foreign Application Priority Data

Feb. 15, 2012 (EP) ..... 12155635

(51) Int. Cl.

| | |
|---|---|
| ***G04B 19/18*** | (2006.01) |
| ***G04B 37/22*** | (2006.01) |
| ***G04B 45/00*** | (2006.01) |
| ***C25D 5/02*** | (2006.01) |
| ***B44C 1/26*** | (2006.01) |

(52) U.S. Cl.

CPC ... *C25D 5/02* (2013.01); *B44C 1/26* (2013.01); *G04B 19/18* (2013.01); *G04B 45/00* (2013.01); *G04B 37/226* (2013.01); *G04B 45/0076* (2013.01); *Y10T 428/12063* (2015.01)

(58) Field of Classification Search

CPC .... G04B 19/10; G04B 19/18; G04B 37/0008; G04B 37/226; G04B 45/0076; B44C 5/005; B44C 5/04; B44C 5/0415; B44C 1/26; C25D 5/02; Y10T 428/12063

USPC ..... 368/223, 232, 281, 285

See application file for complete search history.

(56) References Cited

U.S. PATENT DOCUMENTS

| | | | | |
|---|---|---|---|---|
| 5,270,612 | A * | 12/1993 | Fogelson | 313/477 R |
| 2002/0097279 | A1 | 7/2002 | Mimura et al. | |
| 2004/0032797 | A1 * | 2/2004 | Sato et al. | 368/232 |
| 2004/0233795 | A1 * | 11/2004 | Fujii et al. | 368/285 |
| 2005/0126917 | A1 * | 6/2005 | Morimoto | 205/50 |
| 2005/0185518 | A1 * | 8/2005 | Kawakami et al. | 368/232 |
| 2010/0214882 | A1 * | 8/2010 | Bourban et al. | 368/232 |
| 2011/0103199 | A1 | 5/2011 | Winkler et al. | |
| 2011/0236580 | A1 * | 9/2011 | Winkler et al. | 427/282 |
| 2011/0259753 | A1 | 10/2011 | Grossenbacher et al. | |

FOREIGN PATENT DOCUMENTS

| | | | |
|---|---|---|---|
| EP | 2 138 323 | A1 | 12/2009 |
| EP | 2 380 864 | A1 | 10/2011 |

OTHER PUBLICATIONS

European Search Report issued Jul. 10, 2012, in European Patent Application No. 12155635.1, filed Feb. 15, 2012 (with English Translation ).

* cited by examiner

*Primary Examiner* — Vit W Miska

(74) *Attorney, Agent, or Firm* — Oblon, McClelland, Maier & Neustadt, L.L.P.

(57) ABSTRACT

An element including a body including at least one recess forming the pattern cavity for a decoration, the at least one recess being entirely filled by a galvanic deposition in order to form an element inlaid with at least one metallic decoration with improved visual quality. The element includes a device for fixedly securing the at least one metallic decoration communicating with the at least one recess in order to improve the securing of the at least one decoration against said element.

23 Claims, 4 Drawing Sheets

DEVICE FOR FIXEDLY SECURING A METALLIC INLAY

This application claims priority from European Patent Application No. 12155635.1 filed Feb. 15, 2012, the entire disclosure of which is incorporated herein by reference.

FIELD OF THE INVENTION

The invention relates to an element inlaid of at least one metallic decoration and more specifically an element of this type comprising a device for fixedly securing at least one metallic decoration.

BACKGROUND OF THE INVENTION

It is known to form watch bezels at least partially made of synthetic sapphire in order to show, through transparency, a deposit plated in a recess underneath the bezel, for example, forming a scale or a brand name. This configuration has the advantage of protecting the deposit from any mechanical degradation by totally covering it with the sapphire part. However, this configuration may make it difficult to read the decoration because of altered transmission of the colouring of the deposit but also because of the lack of difference in shade between the sapphire and the deposit.

SUMMARY OF THE INVENTION

It is an object of the present invention to overcome all or part of the aforementioned drawbacks, while maintaining the advantage of mechanical resistance and adding the advantage of improved visual quality.

The invention therefore relates to an element comprising a body including at least one recess forming the pattern cavity of a decoration, said at least one recess being entirely filled by a galvanic deposition in order to form an element inlaid of at least one metallic decoration with improved visual quality, characterized in that it comprises a device for fixedly securing said at least one metallic decoration including at least one hole through said element, communicating with said at least one recess and being at least partially filled with said galvanic deposition in order to improve the securing of said at least one decoration to said element.

Advantageously according to the invention, the decorations are thus more resistant to being removed without being aesthetically modified.

In accordance with other advantageous features of the invention:

- the diameter of said at least one hole flares gradually as it gets further away from said at least one recess so as to hold said galvanic deposition against said element;
- the galvanic deposition completely fills said at least one hole;
- the galvanic deposition covers the shoulder at the end of said at least one hole which is opposite the end communicating with said at least one recess in order to block any movement of said at least one decoration relative to the body;
- the galvanic metal deposition includes gold and/or copper and/or silver and/or indium and/or platinum and/or palladium and/or nickel;
- each at least one recess has a depth comprised between 80 μm and 200 μm to improve the force of adherence;
- the body is made of electrically conductive ceramic material such as a cermet;

- the body is electrically non-conductive such as zironica-based and the decoration further comprises an electrically conductive layer of substantially 50 nm between the body and the galvanic deposition.

Moreover, the invention relates to a portion of the external part of a timepiece, or more generally to a timepiece or to a piece of jewellery, characterized in that it comprises at least one element according to any of the preceding variants.

Finally, the invention relates to a method of manufacturing an element including the following steps:

a) forming a body;

b) etching at least one recess in one surface of the body, each at least one recess forming the pattern cavity for a decoration;

c) etching at least one through hole in said body communicating with said at least one recess so as to form a securing device;

d) galvanically depositing a metallic material so as to completely fill said at least one recess and at least partially fill said at least one hole;

e) removing any deposition from the surface of the body, so as to only leave the deposition in the hollow of said at least one recess and of said at least one hole.

Advantageously according to the invention, the decorations are manufactured deep inside the element therefore making them more resistant to being removed but without aesthetically modifying said decorations.

In accordance with other advantageous features of the invention:

- the diameter of said at least one hole flares gradually as it gets further away from said at least one recess so as to hold said galvanic deposition against said element;
- in step d), the metal deposition completely fills said at least one hole;
- in step d), the metal deposition covers the shoulder of the end of said at least one hole which is opposite that communicating with said at least one recess in order to block any movement of at least one decoration relative to the body;
- the body is made of electrically conductive ceramic material;
- the body is made of electrically non-conductive ceramic material and between step c) and step d), the method further comprises step f): depositing at least one electrically conductive layer of substantially 50 nm over the entire surface comprising said at least one recess and said hole;
- step f) is achieved by electroless plating or by physical vapour deposition;
- step a) is achieved by sintering;
- step b) is achieved by laser at a depth comprised between 80 μm and 200 μm so as to improve the force of adherence;
- step c) is achieved by laser by orienting the beam from the surface opposite that intended to receive said at least one recess;
- steps b) and c) are reversed;
- each at least one recess has a continuous, at least partially rounded surface so as to facilitate implementation of step d).

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
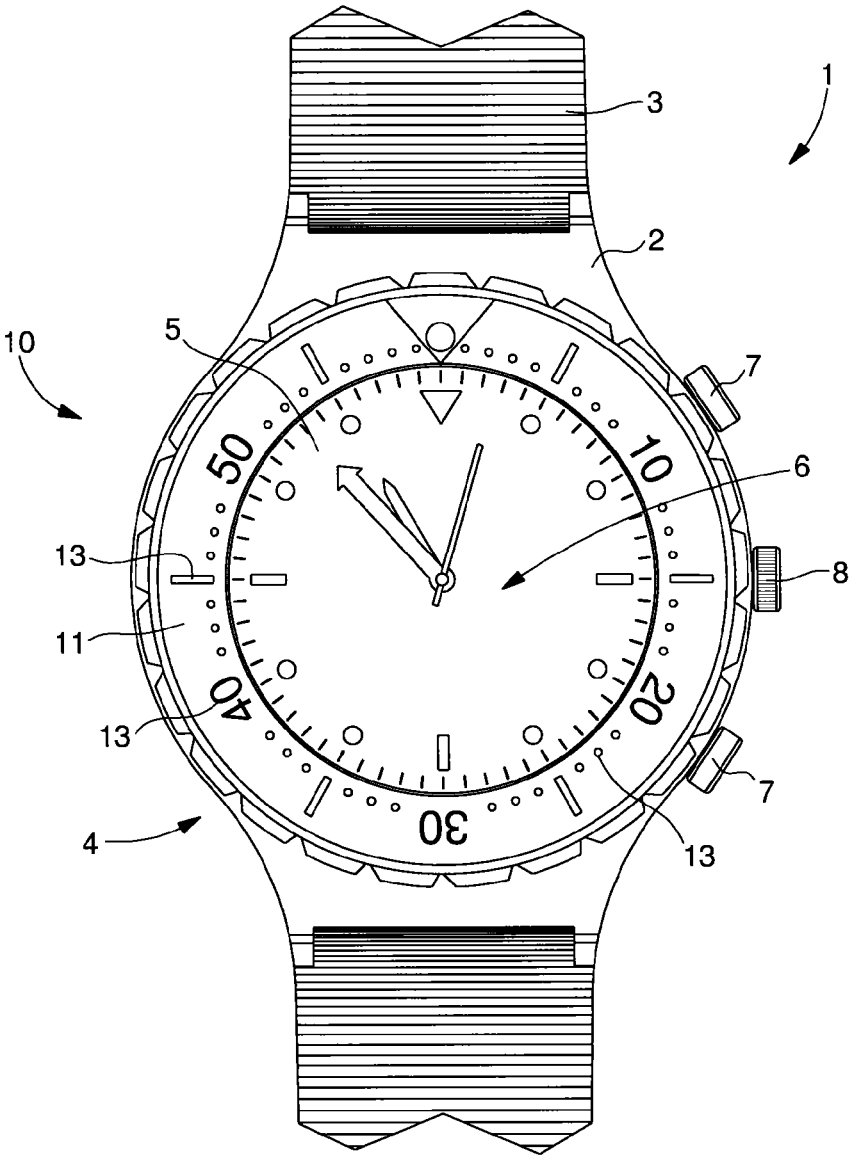
FIG. 1 is a diagram of a timepiece according to the invention.

The example illustrated in FIG. 1 shows a timepiece, generally referenced 1, including at least one inlaid element 10. Each inlaid element 10 is intended to form a part that is very resistant to wear, including at least one metallic decoration 13 whose visual quality is improved, particularly in terms of contrast.

The inlaid element 10 according to the invention may form either all or part of the external part of timepiece 1. Thus, it could form all or part of a case 2, bracelet 3, bezel 4, dial 5, crystal 6, push button 7 and/or a crown 8. In the example illustrated below, the explanation of the invention will be given with reference to a ring 10 including inlaid decorations 13, forming the scale marks of a bezel 4. It is also possible to form inlaid elements 10 for a timepiece movement such as, for example, a bridge and/or a plate and/or an oscillating weight.

Figure 2:
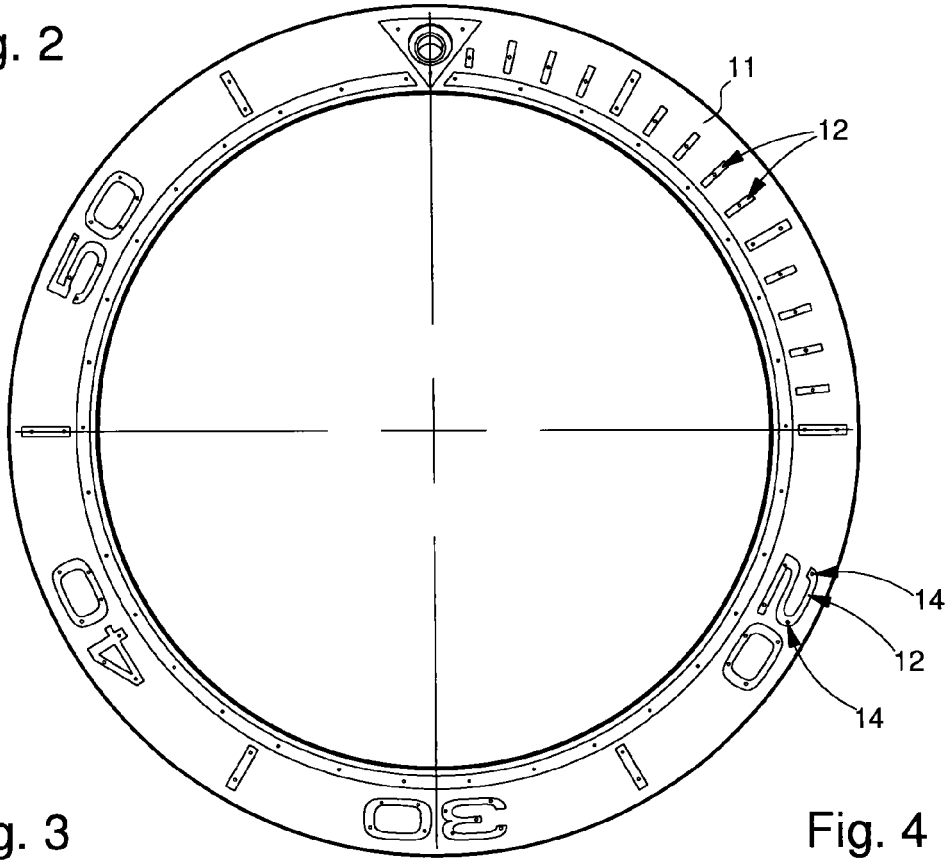
FIG. 2 is a top view of a ceramic element before it is inlaid according to the invention.
Figure 3:
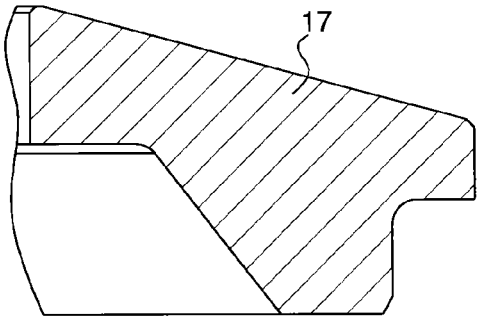
FIGS. 3 to 8 are successive steps of the manufacturing method according to the invention.
Figure 4:
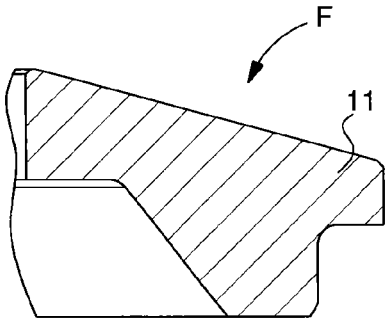
Figure 8:
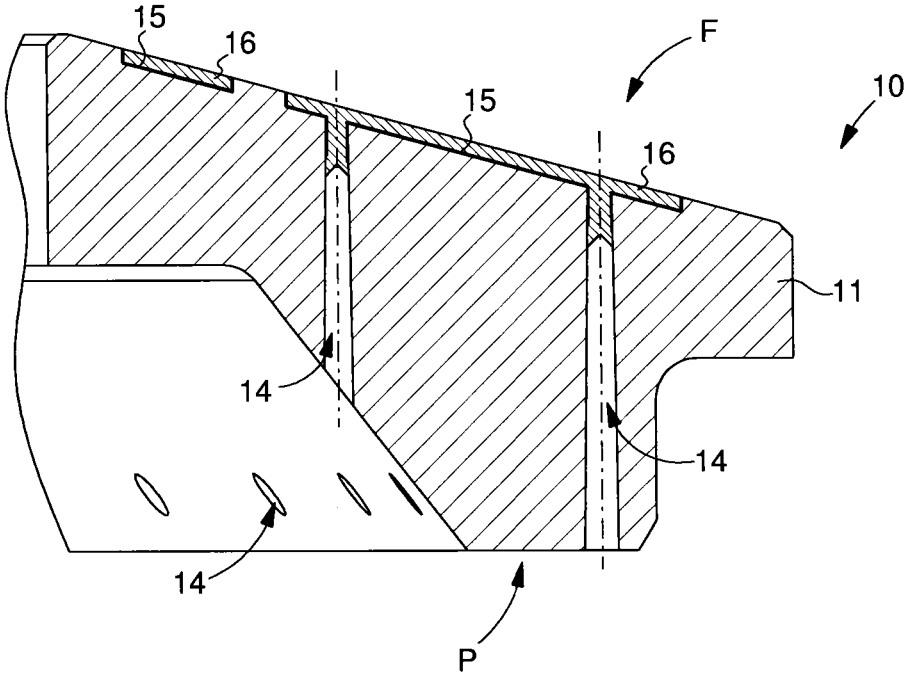

As illustrated in FIGS. 1, 2 and 8, inlaid ceramic element 10 includes a body 11 including at least one recess 12 forming the pattern cavity for a decoration 13. FIG. 1 shows that, advantageously according to the invention, each decoration 13 may take any form, such as, for example, a geometrical figure or an alphanumerical character. According to the invention, each recess 12 is entirely filled with a galvanic deposition 16 formed by a metallic material. This configuration protects each decoration 13 in body 11.

According to a preferred embodiment, body 11 is made of electrically conductive material such as a cermet. A cermet is a material formed by a mixture of ceramic and metal. It may, for example, include TiC, SiN or ZrC to form all or part of body 11.

However, according to a second variant, body 11 may also be made of a material which is not electrically conductive. In that case, decoration 13 further includes at least one electrically conductive layer 15 of substantially 50 nm between body 11 and galvanic deposition 16. Body 11 may then be formed, for example, of a zirconia-based ceramic used for its mechanical properties, polishing ability and, to a lesser extent, for its ability to offer a broad palette of colours.

It is thus clear, according to the invention, that body 11 may be formed from an electrically conductive or non-conductive material. Consequently, body 11 is obtainable from a large variety of materials.

In order to improve the adherence of decoration 13 in body 11, recess 12 preferably has a depth comprised between 80 μm and 200 μm.

Moreover, for the purposes of the adherence of the galvanic deposition, preferably each recess 12 has a continuous, at least partially rounded surface, i.e. the inner surface thereof does not include any edges.

Finally, inlaid element 10 further includes a device for fixedly securing said at least one metallic decoration 13 communicating with said at least one recess 12 to improve the securing of said at least one decoration 13 against said element 10. Preferably, the securing device includes at least one hole 14 through said element 10 which is at least partially filled by said galvanic deposition 16 and, where appropriate, said at least one electrically conductive layer 15 in order to increase the surface of contact with said element.

In the example illustrated in FIG. 8, it is also seen that the diameter of hole 14 may flare gradually as it gets further away from said at least one recess 12 in order to hold said galvanic deposition 16 and, where appropriate, said at least one electrically conductive layer 15, against said element 10. Indeed, in the case where hole 14 is substantially conical, since the diameter of hole 14 opening into recess 12 is smaller than the rest of hole 14, decorations 13 can no longer be removed.

Figure 10:
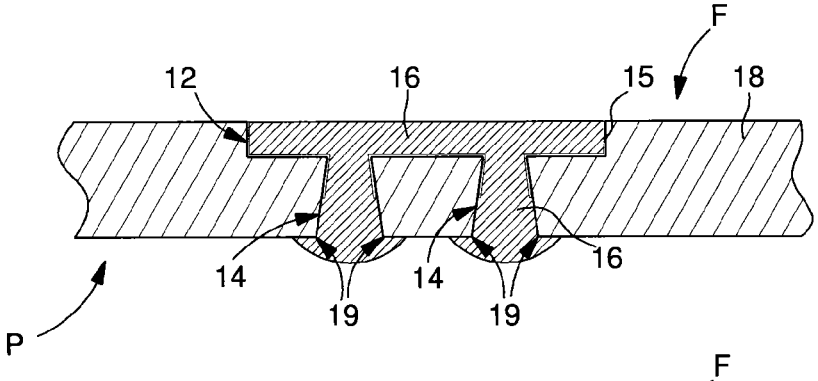
FIGS. 10 and 11 are alternative embodiments of the securing device according to the invention.
Figure 11:
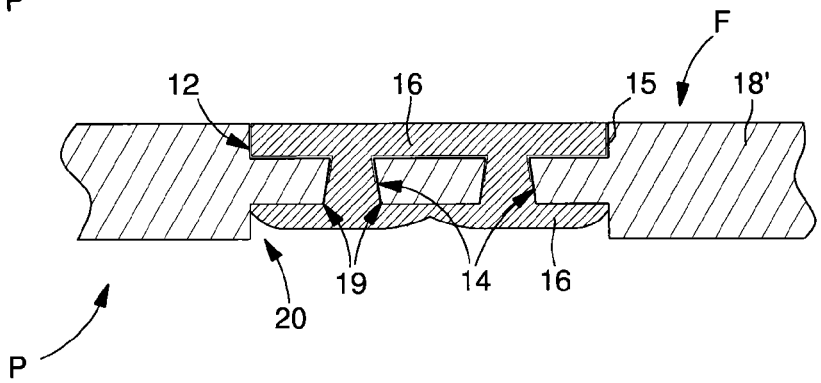

According to the alternatives of the securing device seen in FIGS. 10 and 11, galvanic deposition 16 may also completely fill said at least one hole 14 in order to maximise the surface of contact with body 18, 18' of the element. These two alternatives are possible when the thickness of body 18, 18' is substantially equal to or less than four times the depth of recesses 12, such as, for example, a timepiece dial 5.

According to a first alternative illustrated in FIG. 10, body 18 includes at least one recess 12 communicating with at least one hole 14 which opens onto the surface P opposite the surface F intended to receive said at least one recess 12. It is thus clear that body 18 is hollowed on both sides. Moreover, preferably, galvanic deposition 16 covers shoulder 19 of the end of said at least one hole 14 which is opposite the end communicating with said at least one recess 12 in order to block any movement of said at least one decoration 13 relative to body 18. It is thus clear that galvanic deposition 16 projects relative to said opposite surface P.

According to a second alternative illustrated in FIG. 11, body 18' includes at least one recess 12 communicating with at least one hole 14 which opens onto a recess 20 in the surface P opposite surface F intended to receive said at least one recess 12. It is thus clear that body 18' is hollowed on both sides. Moreover, preferably, galvanic deposition 16 covers shoulder 19 of the end of said at least one hole 14 which is opposite the end communicating with said at least one recess 12 in order to block any movement of said at least one decoration 13 relative to body 18'. It is thus clear that galvanic deposition 16 is intended to remain only in recess 20, i.e. not to project relative to said opposite surface P.

Optionally, it is possible to use a layer intended to improve the force of adherence of the future decoration 13 onto body 11. Indeed, although the micro-roughness of the bottom of recess 12 and the securing device contribute to adherence, a layer, for example of substantially 50 nm, may be deposited between galvanic deposition 16 and where appropriate, electrically conductive layer 15 and body 11, 18, 18'. Depending upon the method of deposition used for the intermediate layer, several types of materials may be envisaged, such as, for example, Cr, $Cr_2N$, TiN, TiW, Ni, NiP, Cu, Ti or Zr.

Galvanic deposition 16 and, where appropriate, said at least one electrically conductive layer 15 may also be formed from a wide variety of materials. Preferably for the second variant, electrically conductive layer 15 is selected for its adherence properties and for its high level of electrical conductivity, which is necessary for electroforming.

Moreover, according to the invention, the visual rendering of each decoration 13 is mainly obtained via the colour of galvanic deposition 16. Consequently, the material used for galvanic deposition 16 will preferably be guided by the colour, or more generally, the aesthetic appearance thereof. Therefore, metal galvanic deposition 16 and, incidentally, layer 15 include gold and/or copper and/or silver and/or indium and/or platinum and/or palladium and/or nickel.

By way of example, it is thus possible to obtain a complex visual rendering by giving body 11 a shiny appearance and a satin appearance to decorations 13. Further, decorations 13 may be formed with the same metal to offer a homogeneous appearance or with several different metals in order, for example, to provide a different colour between two decorations such as one colour for the indices and another for the alphanumerical characters in the case of FIG. 1.

In order to make the colours uniform, it is also possible to envisage forming decorations 13 in the same material as that surrounding body 11, 18, 18'. One could thus, in an embodiment example of FIG. 1, have decorations 13 of bezel 4 in the same material as case 2, bracelet 3, the rest of bezel 4, dial 5, push buttons 7 and/or crown 8.

Optionally, the inlaid element 10 may, according to the invention, also provide an optional, substantially transparent layer, in order to protect decorations 13 from ageing. This layer may, for example, include silicon nitride to prevent galvanic deposition 16 and, where appropriate, said at least one electrically conductive layer 15 from tarnishing, especially when they are mainly silver-based.

The method 21 of manufacturing an inlaid element 10 will now be explained with reference to FIGS. 2 to 9 with the example of an electrically non-conductive, ceramic body 11. Of course, body 11 may be manufactured from a material other than electrically non-conductive ceramic, as explained above.

Figure 9:
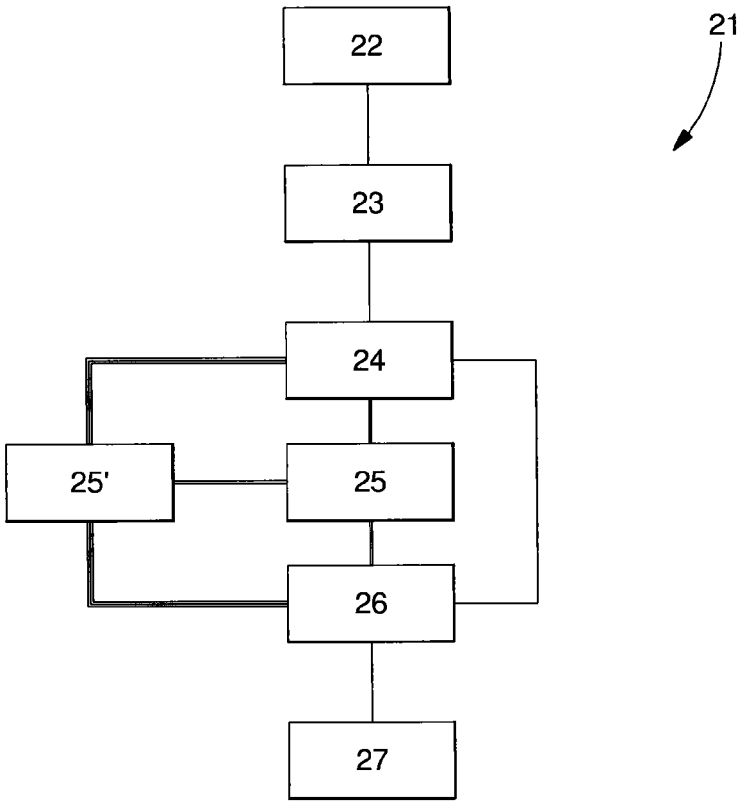
FIG. 9 is a flow diagram of the method according to the invention.

In a first step 22 illustrated in FIG. 9, method 21 consists in forming the body 11, for example, of zirconia. As is partially shown by the change from FIG. 3 to FIG. 4, the final body 11 of step 22 is preferably obtained by sintering, i.e. from an unfired body 17 preformed via an injection process. At the end of step 22, the body 11 visible in FIG. 4 has its final dimensions.

Figure 5:
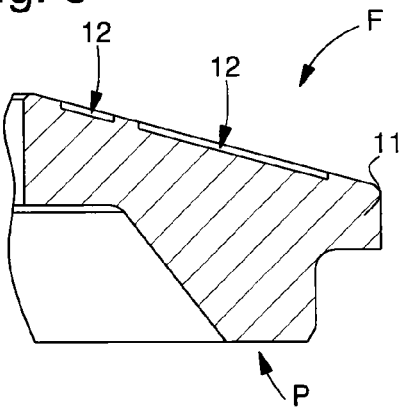

As illustrated in FIG. 9, method 21 includes a second step 23, for etching at least one blind recess 12 in one surface F of ceramic body 11, with recesses 12 forming the pattern cavity for future decorations 13 as visible in FIGS. 2 and 5. Preferably, each recess 12 has a depth P comprised between 80 μm and 200 μm. Moreover, preferably, each recess 12 has a continuous, at least partially rounded surface in order to facilitate implementation of the electroforming step 26 explained below. Step 23 is preferably obtained by destructive radiation using a laser in order to obtain highly precise etchings.

Figure 6:
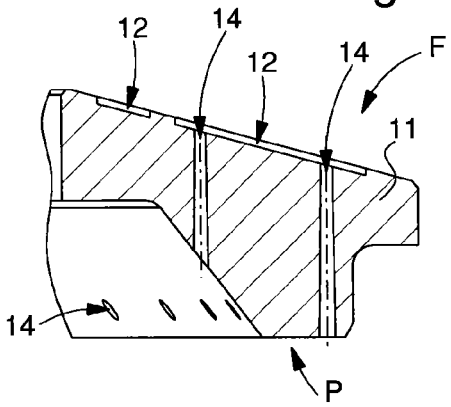

As illustrated in FIG. 9, method 21 continues with a third step 24 for etching at least one hole 14 communicating with each recess 12 so as to form a securing device. As seen in FIGS. 2 and 6, depending upon the shape and span of each recess 12, one or several holes 14 are made for each recess 12. Step 24 is preferably obtained by destructive radiation using a laser in order to obtain highly precise etchings.

According to the invention, each hole 14 passes through body 11 of element 10 so that it can be at least partially filled during step 26 by the metallic material 16 and, where appropriate, during steps 25 and 25' by said at least one electrically conductive layer 15, in order to increase the surface of contact with said element. Indeed, it is clear that the electrolyte can thus flow "in front of" and "behind" recess 12, i.e. it can be deposited in each recess 12 and in each hole 14 at any time in electroforming step 26.

Finally, as seen in FIG. 6, the diameter of each hole 14 flares gradually as it gets further away from said at least one recess 12, in order to block the future metallic material 16 and, where appropriate, said at least one electrically conductive layer 15 against element 10. Indeed, as explained above, in the case where each hole 14 is substantially conical, since the diameter of hole 14 opening into recess 12 is smaller than the rest of hole 14, the decorations 13 can no longer be removed. Preferably, each hole 14 can thus have a diameter substantially equal to 100 μm at the bottom of recess 12 and finish with a diameter substantially equal to 120 μm or more on the surface P opposite body 11.

Preferably, advantageously according to the invention, step 24 is achieved by orienting the laser beam from the opposite surface P so as to form said at least one hole 14 immediately in a conical manner, i.e. in which the largest diameter is at the join with the opposite surface P.

In a first embodiment, seen in triple lines in FIG. 9, step 24 continues with step 25' of method 21 consisting in depositing at least one electrically conductive layer 15 of substantially 50 nm over the whole of surface F comprising said at least one recess 12 and said at least one hole 14. Step 25' may be achieved by a wet method, such as, for example, electroless plating, or by a dry method, such as, for example, physical vapour deposition. In the first embodiment, after step 25', method 21 continues with step 26.

Consequently, this layer 15 may, for example, be made of gold and/or copper and/or silver and/or indium and/or platinum and/or palladium and/or nickel.

In a second embodiment, seen in double lines in FIG. 9, step 24 is followed by step 25 of method 21 consisting in depositing an intermediate layer as explained above. The intermediate layer is then preferably made using a dry method, such as, for example, physical vapour deposition. In the second embodiment, after this step 25, method 21 continues either with step 25' of the first embodiment before passing to step 26, or immediately with step 26.

Finally, in a third embodiment, seen in a single line in FIG. 9, step 24 is immediately followed by step 26. This embodiment concerns the first variant which preferably uses an electrically conductive ceramic as the material for body 11.

Figure 7:
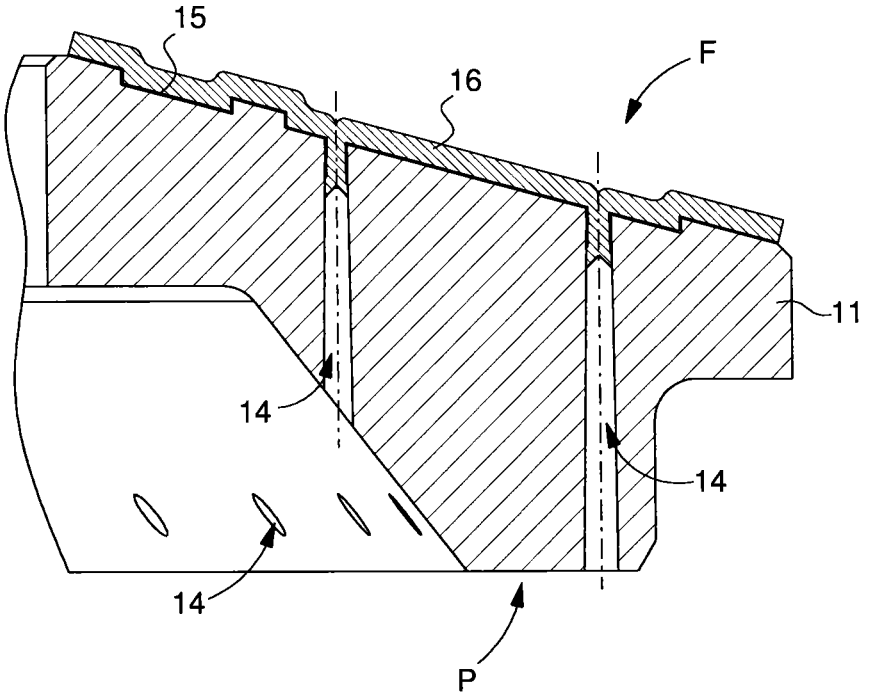

Step 26 consists of the galvanic deposition of a metallic material 16 from surface F of body 11 and, where appropriate, conductive layer 15, so as to completely fill each recess 12 and at least partially fill each hole 14, as seen in FIG. 7. Further, as explained in the two alternatives of the securing device of FIGS. 10 and 11, in step 26, the metallic deposition 16 can completely fill said at least one hole 14. Finally, in this same step 26, metal deposition 16 covers shoulder 19 of the end of said at least one hole 14, which is opposite the end communicating with said at least one recess 12 so as to block any movement of at least one decoration 13 relative to body 18, 18'.

Preferably, in order to facilitate this filling, electrolyte renewal is forced by agitation in recesses 12, holes 14 and, where appropriate, recesses 20, i.e. by implementing a forced displacement of the galvanic bath fluids, so as to prevent any problems in filling recesses 12, holes 14 and, where appropriate, recesses 20.

As explained above, depending upon the colour or more generally the desired visual rendering, the metallic material deposited in step 26 includes gold and/or copper and/or silver and/or indium and/or platinum and/or palladium and/or nickel.

Finally, in a sixth step 27, method 21 ends with the removal of any deposition 16, and where appropriate, 15 from surface F of body 11, 18, 18', so that deposition is only left in each recess 12 and holes 14 as seen in FIGS. 8, 10 and 11. Inlaid element 10 is thus finished and simply requires assembly in a final part. This step 27 can be obtained by a usual surfacing method such as grinding or lapping to remove any surplus material, followed by polishing.

Method 21 according to the invention may also have an optional final step for depositing a substantially transparent layer so as to protect decorations 13 from ageing. This layer may, for example, include silicon nitride to prevent metallic material 16 and, where appropriate, said at least one electrically conductive layer 15 from tarnishing, especially when they are mainly formed from a silver base.

Of course, this invention is not limited to the illustrated example but is capable of various variants and alterations that will appear to those skilled in the art. In particular, the application of inlaid element 10 according to the invention is in no way limited to a timepiece 1. Thus, inlaid element 10 could, by way of example, be applied to a piece of jewellery or even to tableware.

Moreover, the forming of recesses 12 in step 23 could also be switched with the forming of holes 14 in step 24 without losing the advantages of the invention. It is also possible to envisage substituting laser etching in step 23 and/or step 24 with another type of etching if the precision and reject rate thereof are acceptable.

Finally, it should also be noted that step 25 or step 25' is not limited to electroless plating or physical vapour deposition, but may alternatively be achieved, for example, by chemical vapour deposition, atomic layer deposition or ionic bombardment.

What is claimed is:

1. An element comprising a body including at least one recess on one side of said body, said at least one recess forming a pattern cavity of a decoration, the at least one recess being entirely filled by a galvanic deposition so as to form an element inlaid of at least one metallic decoration, wherein the element includes a device for fixedly securing the at least one metallic decoration, said device comprising at least one through-hole through said element, said through-hole having a first end communicating with the at least one recess and a second end communicating with another side of said body, said through-hole being at least partially filled with the galvanic deposition so as to improve the securing of the at least one metallic decoration against the element.

2. The element according to claim 1, wherein the diameter of the at least one through-hole flares gradually as said diameter gets further away from the at least one recess so as to hold the galvanic deposition against the element.

3. The element according to claim 1, wherein the galvanic deposition completely fills said at least one through-hole.

4. The element according to claim 3, wherein the galvanic deposition covers the shoulder of the second end of the at least one through-hole, in order to block any movement of the at least one decoration relative to the body.

5. The element according to claim 1, wherein the galvanic metal deposition includes gold and/or copper and/or silver and/or indium and/or platinum and/or palladium and/or nickel.

6. The element according to claim 1, wherein each at least one recess has a depth comprised between 80 μm and 200 μm.

7. The element according to claim 1, wherein the body is made of electrically conductive ceramic material.

8. The element according to claim 7, wherein the body is completely or partially formed by a cermet.

9. The element according to claim 1, wherein the body is electrically non-conductive and wherein the decoration further includes at least one electrically conductive layer of substantially 50 μm between the body and the galvanic deposition.

10. The element according to claim 9, wherein the body is formed from a base of zirconia.

11. A timepiece wherein it includes at least one element according to claim 1.

12. The timepiece according to claim 11, wherein the body of the at least one element forms all or part of a case and/or a bracelet and/or a bezel and/or a dial and/or a crystal and/or a push-button and/or a crown.

13. A method for fabricating an element comprising the following steps:

a) forming a body;

b) etching at least one recess in a first surface of the body, each at least one recess forming the pattern cavity for a decoration;

c) etching at least one through-hole through the body, said through-hole having a first end communicating with the at least one recess and a second end communicating with a second surface of said body, said through-hole thereby forming part of a securing device;

d) galvanically depositing a metallic material in order to completely fill the at least one recess and at least partially fill the at least one through-hole;

e) removing all the deposition from the first surface of the body, so that the deposition is only left in the hollow of the at least one recess and of the at least one through-hole.

14. The method according to claim 13, wherein the diameter of the at least one through-hole flares gradually as said diameter gets further away from the at least one recess in order hold the galvanic deposition against the element.

15. The method according to claim 13, wherein, during step d), the metal deposition completely fills the at least one through-hole.

16. The method according to claim 15, wherein, in step d), the metal deposition covers a shoulder of the second end of the at least one through-hole, in order to block any movement of at least one decoration relative to the body.

17. The method according to claim 13, wherein the body is made of electrically conductive ceramic material.

18. The method according to claim 13, wherein the body is made of electrically non-conductive ceramic material and wherein, between step c) and step d), the method further includes the following step:

f) depositing at least one electrically conductive layer of approximately 50 nm over the entire area including the at least one recess and the at least one hole.

19. The method according to claim 18, wherein step f) is achieved by electroless plating or by physical vapour deposition.

20. The method according to claim 13, wherein step b) is achieved by using a laser at a depth comprised between 80 μm and 200 μm.

21. The method according to claim 13, wherein step c) is achieved by laser by orienting the beam from the second surface.

22. The method according to claim 13, wherein steps b) and c) are reversed.

23. The method according to claim 13, wherein each at least one recess includes a continuous or at least partially flattened surface in order to facilitate the implementation of step d).

* * * * *